United States Patent [19]

Murata et al.

[11] 4,028,283

[45] June 7, 1977

[54] GRANULAR OR POWDERY DETERGENT COMPOSITION

[75] Inventors: Moriyasu Murata, Chiba; Fumio Sai, Funabashi; Takashi Fujino, Yokohama, all of Japan

[73] Assignee: Kao Soap Co., Ltd., Tokyo, Japan

[22] Filed: Sept. 21, 1976

[21] Appl. No.: 725,184

[30] Foreign Application Priority Data

Sept. 30, 1975 Japan ..... 50-117816

[52] U.S. Cl. ..... 252/551; 252/89 R; 252/135; 252/532; 252/533; 252/534; 252/535; 252/536; 252/537; 252/539; 252/540; 252/550; 252/552; 252/553; 252/554; 252/555; 252/556; 252/558; 252/559

[51] Int. Cl.[2] ..... C11D 1/06; C11D 1/37

[58] Field of Search ..... 252/89, 135, 531, 532, 252/533, 535, 536, 539, 540, 550, 551, 553, 554, 555, 556, 558, 559; 260/346.6, 346.7, 546

[56] References Cited

UNITED STATES PATENTS

| | | | |
|---|---|---|---|
| 2,557,155 | 6/1951 | Strashun | 252/384 X |
| 2,835,696 | 5/1958 | Steinhauser | 260/468 |
| 2,863,907 | 12/1958 | Schmerling | 260/473 |
| 3,009,882 | 11/1961 | Clarke et al. | 252/116 |
| 3,082,154 | 3/1963 | Allan | 252/384 X |
| 3,141,897 | 7/1964 | Crecelius et al. | 260/404.8 |
| 3,567,784 | 3/1971 | Tsatas et al. | 260/615 |
| 3,960,780 | 6/1976 | Murata et al. | 252/532 |
| 3,962,152 | 6/1976 | Nicol et al. | 252/551 |

FOREIGN PATENTS OR APPLICATIONS 586,740 11/1959 Canada

*Primary Examiner*—P.E. Willis, Jr.
*Attorney, Agent, or Firm*—Woodhams, Blanchard and Flynn

[57] ABSTRACT

A granular or powdery detergent composition comprising (I) as an active detergent component a surface active agent having a tendency to cake, and (II) as an anti-caking agent, from 0.2 to 20% by weight, based on the total weight of the detergent composition, of a carboxylic acid or an alkali metal salt thereof obtained by reacting (A) a polyalkylene glycol and (B) an acid anhydride, at an (A)/(B) mole ratio of from 1/2 to 1/1, said polyalkylene glycol being selected from (i) polyethylene glycols having an average molecular weight of 2000 to 10000 and (ii) nonionic surface active agents having the formula:

$$HO(CH_2CH_2O)_a(\underset{\underset{CH_3}{|}}{C}HCH_2O)_b(CH_2CH_2O)_cH$$

wherein *a*, *b* and *c* are numbers satisfying the relations:

$$140 \leqq a + c \leqq 200 \text{ and } 30 \leqq b \leqq 40,$$

and the acid anhydride is selected from the group consisting of maleic anhydride, phthalic anhydride and succinic anhydride, and wherein the weight ratio of (II)/(I) is from 1/10 to 3/2.

5 Claims, No Drawings

GRANULAR OR POWDERY DETERGENT COMPOSITION

BACKGROUND OF THE INVENTION

1. Field of the Invention

The present invention relates to an improved non-caking granular or powdery detergent composition comprising as an active detergent component a surface active agent having a tendency to cake.

2. Description of the Prior Art

Recently, the eutrophication problem caused by the use of sodium tripolyphosphate as a builder in powdery detergents has become important, and it is now desired to reduce the content of sodium tripolyphosphate in detergents. In order to do this, utilization of a surface active agent having a detergency that is not degraded by water hardness has recently been proposed. Alkylethoxy sulfate salts and nonionic surfactants have attracted attention in the art for this purpose. However, powdery detergents containing these surface active agents tend to cake and therefore, it is difficult to put them into practical use.

The present invention relates to improved granular or powdery detergent compositions comprising at least one member selected from hard water-resistant surface active agents such as alkylethoxy sulfate salts, alkylphenylethoxy sulfate salts and ethylene oxide type nonionic surface active agents and from other surface active agents having a tendency to cake, such as branched alkyl sulfate salts, alkanesulfonate salts, vinylidene type olefin-sulfonate salts and internal olefin type sulfonate salts, in which the caking tendency is remarkably reduced.

The caking property of a granular or powdery detergent has a bad effect not only on the manufacturing process but also on the handling of the detergents in households, and the commercial value of a detergent having a tendency to cake is very low. Accordingly, it is very important to prevent caking in granular or powdery detergents.

It is known from experience that the caking property of a granular or powdery detergent is greatly influenced by the kind of the surface active agent employed. For example, sodium benzenesulfonate and sodium toluenesulfonate are effective for preventing caking of detergents containing branched alkylbenzenesulfonate salts and sodium sulfosuccinate is effective for preventing caking of detergents containing linear alkylbenzenesulfonate salts. But it is said that the caking-preventing activity of sodium sulfosuccinate is not high for the former surface active agents and the caking-preventing activity of sodium benzene-sulfonate or sodium toluenesulfonate is not high for the latter surface active agents.

Although the above-mentioned surface active agents having a tendency to cake have an excellent detergent activity, they are disadvantageous in that granular or powdery detergent compositions containing these surface active agents tend to cake and their commercial values are very low.

SUMMARY OF THE INVENTION

We have discovered that a carboxylic acid or alkali metal salt thereof which is solid at ambient temperature, i.e. at a temperature below about 35° C, and which is prepared by reacting a polyalkylene glycol with an acid anhydride has a very high anti-caking effect in detergent compositions comprising a surface active agent having a tendency to cake. We have now completed the present invention based on this finding.

More specifically, in accordance with the present invention, there is provided a granular or powdery detergent composition comprising (I) as an active detergent component, from 2 to 40%, preferably 6 to 25%, by weight, of a surface active agent having a tendency to cake, and (II) as an anti-caking agent, from 0.2 to 20%, preferably 1 to 10%, and more preferably 3 to 8%, by weight, of a carboxylic acid obtained by reacting (A) a polyalkylene glycol and (B) an acid anhydride, at an (A)/(B) mole ratio of from 1/2 to 1/1, or an alkali metal salt of said carboxylic acid, said polyalkylene glycol being selected from (i) polyethylene glycols having an average molecular weight of 2000 to 10000 and (ii) nonionic surface active agents having the formula (I):

$$HO(CH_2CH_2O)_a(\underset{\underset{CH_3}{|}}{C}HCH_2O)_b(CH_2CH_2O)_cH$$

wherein $a$, $b$ and $c$ are numbers satisfying the relations:

$$140 \leqq a + c \leqq 200, \text{ and } 30 \leqq b \leqq 40,$$

the acid anhydride being selected from maleic anhydride, phthalic anhydride and succinic anhydride, and wherein the weight ratio of II/I is from 1/10 to 3/2.

The present invention concerns improvements of the inventions disclosed in Japanese Patent Applications No. 125810/74 (U.S. Pat. Nos. 3 960 780) and 133463/74 (U.S. patent application Ser. No. 632 194). In these prior applications, it is taught that a polyethylene glycol having an average molecular weight of at least 2000 has an anti-caking effect. Namely, the anti-caking effect is owing to the special structure of the polyethylene glycol and its property that it is solid at ambient temperature.

In the present invention, it is necessary that the anti-caking agent should have a carboxyl or alkali metal carboxylate group and should be solid at room temperature. These properties will now be described by reference to the properties of the starting reactants.

When a polyethylene glycol (i) having an average molecular weight of 2000 to 10000 or a nonionic surface active agent (ii) of formula (I) in which the relations of $140 \leqq a + c$ and $30 \leqq b$ are satisfied, is reacted with an acid anhydride, the resulting carboxylic acid is solid at ambient temperature. The anti-caking effect of the carboxylic acid prepared from the polyethylene glycol (i) and the acid anhydride increases with an increase of the molecular weight of the polyethylene glycol when the molecular weight is in the range of from 2000 to 10000, but when the molecular weight is higher than 10000, the effect does not further improve so that the addition of more ethylene oxide is wasteful.

Accordingly, in the present invention it is preferred that the polyethylene glycol (i) has an average molecular weight of 2000 to 10000, preferably 4000 to 8000.

The anti-caking effect of a carboxylic acid obtained from a nonionic surface active agent of formula (I) and an acid anhydride is sufficiently manifested only when the relations of $140 \leqq a + c$ and $30 \leqq b$ are satisfied. For example, Newpol PE-68, Newpol PE-78 and Newpol PE-88 (manufactured by Sanyo Kasei) are surface active agents of formula (I). They are available in the form of flakes which are solid at ambient temperature.

On the other hand, Newpol PE-61 ($a + c \doteqdot 4$ and $b \doteqdot 29$) is pasty at ambient temperature, and the anti-caking effect of a carboxylic acid prepared by reacting Newpol PE-61 with succinic anhydride is insufficient. When the sum of $a$ and $c$ ($a + c$) is larger than 200 and $b$ is larger than 40, the anti-caking effect is not further improved.

The method for reacting the polyalkylene glycol (i) or (ii) with the acid anhydride to form a carboxylic acid is not particularly critical. The reaction can be conducted in the following manner.

The polyalkylene glycol and acid anhydride are generally reacted at a temperature within the range between 50 and 100° C in the absense of catalyst. The reactants are dissolved in a solvent capable of dissolving therein the both and capable of reacting with none of them. As a solvent to be used here, there may be used chlorofolm, acetone, benzene, acetonitrile and the like. Then, the solution is gently heated, such as at the reflux temperature of the mixture. When the temperature is too high or a catalyst such as an acid or alkali is added, a polyester is formed. Accordingly, it is not preferred to add such a catalyst. It is also possible to perform the reaction in the molten state in the absence of a solvent by elevating the temperature above the melting point of one reactant. The process in the molten state can be applied to maleic anhydride (m.p., 52.6° C) to be used as one of reactants. After completion of the reaction, the reaction product is purified by extraction with an aqueous solution of an alkali or passing the reaction mixture through an ion exchange resin. Since the polyalkylene glycol molecule has hydroxyl groups at both ends, by the reaction with the acid anhydride, at most 2 ester linkages are introduced into the reaction product. Accordingly, the resulting carboxylic acid is considered to be a mixture of a monoester and a diester. The composition of the product can be changed by changing the mole ratio of the polyalkylene glycol and acid anhydride that are reacted with each other. When the (A)/(B) mole ratio is 1/1, a monocarboxylic acid monoester may be formed as the main component, and when the above mole ratio is 1/2, a dicarboxylic acid diester may be formed as the main component.

As illustrated in the examples given hereinafter, no substantial difference of the anti-caking effect is observed between the monoester and the diester. Accordingly, since it is not important to show an assumed structure of the carboxylic acid reaction product, the carboxylic acid reaction produce is identified by mention of the names and molecular weight of the reactants and the mole ratios of the reactants. The kind of alkali used for neutralization is indicated according to need.

The amount incorporated of the anti-caking agent of the present invention is determined depending on the content of the surface active agent having a tendency to cake. It is critical that the weight ratio of the anti-caking agent/surface active agent having a tendency to cake is in the range of from 1/10 to 3/2. In order for the surface active agent having a tendency to cake to exert its inherent high hard water-resistant washing activity or ordinary washing activity, the surface active agent having a tendency to cake should be incorporated in an amount of at least 2% based on the total weight of the detergent composition. If the surface active agent having a tendency to cake is incorporated in an amount larger than 40% based on the total weight of the detergent composition, it is practically impossible to prevent caking. It is possible that the anti-caking agent is incorporated in an amount of 0.2 to 60% based on the total weight of the detergent composition, but the use of more than that is wasteful. Accordingly, the anti-caking agent is preferably incorporated in an amount of 0.2 to 20%, preferably 1 to 10%, more preferably 3 to 8%, in the present invention.

When the passage ratio described below is higher than 50%, an acceptable anti-caking effect is attained.

Surface active agents having a tendency to cake, to which the anti-caking agent of the present invention is effectively applied, are as follows:

a. Alkylethoxy sulfate salts and b. alkylphenylethoxy sulfate salts respectively having the formulae:

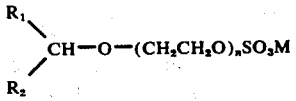

or

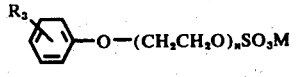

wherein $R_1$ and $R_2$ are hydrogens or alkyls or alkenyls having 1 to 17 carbon atoms, $R_3$ is alkyl or alkenyl having 4 to 16 carbon atoms, with the proviso that the average carbon number of the alcohol or alkyl phenol prior to addition of ethylene oxide is 10 to 18, $n$ is a number of from 0.5 to 5, and M is an alkali metal or alkaline earth metal, c. Branched alkyl sulfate salts having the formula:

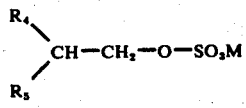

wherein $R_4$ and $R_5$ are alkyls or alkenyls having 1 to 15 carbon atoms, with the proviso that the carbon atom number of one molecule is in the range of from 10 to 18, and M is an alkali metal or alkaline earth metal, d. Alkane-sulfonate salts having the formula:

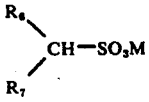

wherein $R_6$ and $R_7$ are hydrogens or alkyls having 1 to 17 carbon atoms, with the proviso that the carbon number of one molecule is in the range of from 10 to 18, and M is an alkali metal or alkaline earth metal, e. Sulfonate salts of vinylidene type olefins having the formula:

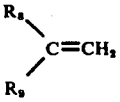

wherein $R_8$ and $R_9$ are alkyls having 1 to 15 carbon atoms, with the proviso that the carbon number of one molecule is in the range of from 10 to 18, and the salt-forming cation is an alkali metal or alkaline earth metal salt., f. Sulfonate salts of internal olefins having the formula:

$R_{10}HC = CHR_{11}$ wherein $R_{10}$ and $R_{11}$ are alkyls having 1 to 17 carbon atoms, with the proviso that the carbon number of one molecule is in the range of from 10 to 20, with the proviso that when one of $R_{10}$ and $R_{11}$ is hydrogen, the olefin is an $\alpha$-olefin may be incorporated in an amount not exceeding 80 %, and the salt-forming cation is an alkali metal or alkaline earth metal salt.

g. Ethylene oxide nonionic surface active agents, such as polyoxyethylene (6 to 12), alkyl ($C_{12}$ to $C_{18}$) or alkenyl ($C_{12}$ to $C_{18}$) ethers, polyoxyethylene (6 to 12) alkyl ($C_6$ to $C_{10}$) phenyl ethers, polyoxyethylene (8 to 20) saturated or unsaturated fatty acid ($C_{12}$ to $C_{18}$) esters and polyoxyethylene (4 to 20) sorbitan saturated or unsaturated fatty acid ($C_{12}$ to $C_{18}$) esters, each having an HBL value of from 8 to 18.

The detergent composition of the present invention comprises from 2 to 40% by weight of at least one of said surface active agents having a tendency to cake as a critical component. In addition, the detergent composition of the present invention may contain 0 to 20% by weight of other surface active agents, for example, sodium and potassium salts of alkylbenzene-sulfonic acids having an alkyl group of 10 to 16 carbon atoms, linear alkyl sulfuric acid esters having an average carbon number of 11 to 18 and $\alpha$-olefin-sulfonic acids having an average carbon number of 10 to 20; 0 to 35% by weight of detergent builders including inorganic builders such as condensed phosphoric acid salts, e.g., sodium tripolyphosphate and sodium pyrophosphate, silicates, carbonates, Glauber salt and borates, organic builders such as nitrilotriacetic acid salts and citric acid salts, re-contamination-preventing agents such as carboxymethylcellulose, polyvinyl alcohol and polyvinyl pyrrolidone, enzymes, bleaching agents, fluorescent dyes, bluing agents, perfumes, and other detergent additives customarily used in clothes washing detergent compositions.

This invention will now be further described by reference to the following illustrative Examples.

Each of the samples used in these Examples was prepared and tested in the following manner:

A detergent slurry comprising 60% by weight of detergent components and 40% by weight of water was charged into a mixing tank of 10 cm in diameter and 12 cm in depth provided with a heating jacket. The slurry was mixed and agitated uniformly at 60° C and then was allowed to stand still for 15 minutes. The slurry was then dried at 60° to 80° C under reduced pressure in a vacuum drum drier until the water content was reduced to substantially zero. The resulting powdery detergent was sieved and particles of a size of 420 to 710 $\mu$ were recovered and allowed to stand still in a tank maintained at a temperature of 30° C and a relative humidity of 80% to adjust the water content to 9 ± 1% by weight, following which the detergent was tested.

The caking property was determined in the following manner:

12.5 g of the sample was filled in a container formed of filter paper (7.4 cm × 4.4 cm × 2.8 cm (height)), and the sample was levelled. An iron plate having a size of 7.2 cm × 4.2 cm was placed on the sample, and in this state the sample was allowed to stand still in a thermostat tank maintained at a temperature of 30° C and a relative humidity of 80% for 7 days. Then, the powdery detergent was placed on a sieve of 4 mm × 4 mm mesh so as to be permitted to pass therethrough, by gravity. The weight A (g) of the powder that remained on the sieve and the weight B (g) of the powder that passed through the sieve were measured. The passage ratio was calculated according to the following equation:

$$\text{Passage ratio (\%)} = \frac{B}{A+B} \times 100$$

A larger value of the passage ratio indicates a lower degree of caking.

In the Examples, the polyethylene glycol (i) is abbreviated to "PEG" and the nonionic surface active agent (ii) is designated as "Pluronic".

PREPARATION

In 500 g of chloroform, 100 g ($1.66 \times 10^{-2}$ mole) of PEG (MW = 6000) and 2.0 g (0.02 moles) of succinic anhydride were heated and refluxed at about 60° C for 2 hours. After completion of the reaction, the chloroform was distilled off on a warm water bath by a vacuum evaporator. The resulting solid was passed through a column packed with Dowex X-4 (the Cl type) and eluted with water to remove nonionic substances such as unreacted PEG. Then, an ethanol-Glauber salt-water mixed solvent was passed through the column to collect the resulting carboxylic acid. Excess ethanol was added to the distillate to collect ethanol-soluble substances. Ethanol was distilled off from the ethanol solution to obtain the intended carboxylic acid. The acid value and saponification value were found to be 9.03 and 18.1, respectively, and the following structure was estimated:

$HO(CH_2CH_2O)_{136}OCOCH_2CH_2COOH$

Since the proportion of the —COOH group in one molecule is much smaller than that of the $H(CH_2CH_2O)_{136}$-group, the above structure could not be confirmed by IR and NMR. It is construed that the product additionally contained small amounts of $HOOCCH_2CH_2COO(CH_2CH_2O)_{136}OCOCH_2CH_2COOH$ and further condensed carboxylic acids. The thus-obtained product was used as it was or after neutralization with KOH or NaOH.

EXAMPLE 1

Powder detergents having the compositions indicated below were prepared, and the passage ratios were measured to evaluate the caking tendency. The results are shown in Table 1.

| | |
|---|---|
| Sodium linear dodecylbenzenesulfonate | 8 parts |
| Sodium alkylethoxysulfate[1] | 12 parts |
| Sodium tripolyphosphate | 20 parts |
| Sodium silicate (JIS No. 2) | 10 parts |
| Sodium carbonate | 5 parts |
| Carboxymethylcellulose | 1 part |
| Water | 10 parts |
| Caking-preventing agent*[2] | 5 parts |
| Glauber salt | balance |
| Total | 100 parts |

*[1]Sodium salt obtained by adding 2.8 moles of ethylene oxide to a mixture of a branched higher alcohol and a linear higher alcohol (Oxocol 1415 manufactured by Nissan Kagaku and having an average carbon atom number of 14.5 and containing 40 wt. % of a branched alcohol in the mixture), and sulfating and neutralizing the adduct.

*[2]Carboxylic acid obtained from polyethylene glycol (A) and acid anhydride (B), its alkali metal salt or a known agent. See Table 1 for identification of components A and B.

Table 1

| Sample No. | A | B | A/B Mole Ratio | Neutralizing Agent | Ratio | Passage (%) |
|---|---|---|---|---|---|---|
| 1 | PEG (MW 200) | none | — | none | R | 26 |
| 2 | PEG (MW 200) | SAn | 1/2 | none | R | 26 |
| 3 | PEG (MW 2000) | none | — | none | R | 80 |
| 4 | PEG (MW 2000) | MAn | 1/2 | none | F | 86 |
| 5 | PEG (MW 6000) | none | — | none | R | 82 |
| 6 | PEG (MW 6000) | SAn | 1/1 | none | F | 87 |
| 7 | PEG (MW 6000) | SAn | 1/2 | NaOH | F | 88 |
| 8 | PEG (MW 10000) | none | — | none | R | 89 |
| 9 | PEG (MW 10000) | FAn | 1/2 | KOH | F | 90 |
| 10 | PEG (MW 20000) | FAn | 1/2 | none | R | 90 |
| 11 | Pluronic (a+c≈4, b≈29) | none | — | none | R | 24 |
| 12 | Pluronic (a+c≈4, b≈29) | SAn | 1/1 | none | R | 25 |
| 13 | Pluronic (a+c≈47, b≈35) | none | — | none | R | 29 |
| 14 | Pluronic (a+c≈47, b≈35) | SAn | 1/1 | none | R | 30 |
| 15 | Pluronic (a+c≈155, b≈30) | none | — | none | R | 63 |
| 16 | Pluronic (a+c≈155, b≈30) | MAn | 1/2 | none | F | 75 |
| 17 | Pluronic (a+c≈182, b≈35) | none | — | none | R | 65 |
| 18 | Pluronic (a+c≈182, b≈35) | FAn | 1/2 | KOH | F | 78 |
| 19 | Pluronic (a+b≈200, b≈39) | none | — | none | R | 65 |
| 20 | Pluronic (a+b≈200, b≈39) | SAn | 1/1 | NaOH | F | 78 |
| 21 | sodium benzene-sulfonate | | | | R | 22 |
| 22 | sodium toluene-sulfonate | | | | R | 23 |
| 23 | sodium sulfo-succinate | | | | R | 25 |
| 24 | not added | | | | R | 15 |

Notes
SAn: succinic anhydride
MAn: maleic anhydride
FAn: phthalic anhydride
R: comparison
F: present invention From the results shown in Table 1, the following facts can be seen as regards detergent compositions comprising a surface active agent having a tendency to cake, the caking tendency of which cannot be prevented by anti-caking agents effective for branched and linear alkylbenzene-sulfonate salts, such as sodium benzene-sulfonate, sodium toluene-sulfonate and sodium sulfo-succinate.

1. A carboxylic acid obtained by reacting PEG with succinic anhydride (SAn), maleic anhydride (MAn) or phthalic anhydride (FAn), or its alkali metal salt, has a conspicuous anti-caking effect when the average molecular weight of the starting PEG is at least 2000, and its effect is superior to the effect of PEG per se.
2. A carboxylic acid obtained by reacting a Pluronic nonionic surface active agent with SAn, MAn or FAn, or its alkali metal salt, has a conspicuous anti-caking effect when the relations $(a+c)>140$ and $b>30$, are satisfied in the starting Pluronic nonionic surface active agent and its effect is superior to the effect of the Pluronic nonionic surface active agent per se.
3. When the molecular weight of PEG is higher than 10000, the effect does not further improve.
4. When the value of $(a+c)$ is larger than 200 and the value of $b$ is larger than 40 in the Pluronic nonionic surface active agent, the effect does not further improve.

EXAMPLE 2

The relation between the amount incorporated of the anti-caking agent and the anti-caking effect attained was examined. The results shown in Table 2 were obtained. All "parts" in Table 2 are by weight (% by weight).

Table 2

| Composition (parts) | Sample No. 25 | 26 | 27 | 28 | 29 | 30 | 31 | 32 | 33 | 34 | 35 | 36 |
|---|---|---|---|---|---|---|---|---|---|---|---|---|
| Sodium linear dodecylbenzene sulfonate | 10 | 10 | 10 | 18 | 18 | 18 | 5 | 5 | 5 | 5 | 5 | 0 |
| Sodium alkylethoxysulfate (same as used in Example 1) | 2 | 2 | 2 | 7 | 7 | 7 | 15 | 15 | 15 | 15 | 15 | 45 |
| Sodium tripolyphosphate | 15 | 15 | 15 | 10 | 10 | 10 | 0 | 0 | 0 | 0 | 0 | 0 |
| Sodium silicate | 10 | 10 | 10 | 10 | 10 | 10 | 5 | 5 | 5 | 5 | 5 | 0 |
| Sodium carbonate | 5 | 5 | 5 | 5 | 5 | 5 | 5 | 5 | 5 | 5 | 5 | 0 |
| Carboxymethylcellulose | 1 | 1 | 1 | 1 | 1 | 1 | 1 | 1 | 1 | 1 | 1 | 0 |
| Water | 8 | 8 | 8 | 7 | 7 | 7 | 5 | 5 | 5 | 5 | 5 | 2 |
| Anti-caking agent (Sample No. 7 used in Example 1) | 0 | 0.1 | 0.2 | 0 | 0.4 | 1 | 0 | 5 | 10 | 20 | 50 | 53 |
| Glauber salt | ← balance → | | | | | | | | | | | |
| Remarks* | R | R | F | R | R | F | R | F | F | F | R | R |
| Passage ratio (%) | 41 | 46 | 59 | 0 | 37 | 62 | 0 | 52 | 55 | 63 | 64 | 32 |

| Composition (parts) | Sample No. 37 | 38 | 39 | 40 | 41 | 42 | 43 | 44 | 45 | 46 | 47 | 48 |
|---|---|---|---|---|---|---|---|---|---|---|---|---|
| Sodium linear dodecylbenzene sulfonate | 10 | 10 | 10 | 18 | 18 | 18 | 5 | 5 | 5 | 5 | 5 | 0 |
| Sodium alkylethoxysulfate (same as used in Example 1) | 2 | 2 | 2 | 7 | 7 | 7 | 15 | 15 | 15 | 15 | 15 | 45 |
| Sodium tripolyphosphate | 15 | 15 | 15 | 10 | 10 | 10 | 0 | 0 | 0 | 0 | 0 | 0 |
| Sodium silicate | 10 | 10 | 10 | 10 | 10 | 10 | 5 | 5 | 5 | 5 | 5 | 0 |
| Sodium carbonate | 5 | 5 | 5 | 5 | 5 | 5 | 5 | 5 | 5 | 5 | 5 | 0 |
| Carboxymethylcellulose | 1 | 1 | 1 | 1 | 1 | 1 | 1 | 1 | 1 | 1 | 1 | 0 |
| Water | 9 | 9 | 9 | 8 | 8 | 8 | 5 | 5 | 5 | 5 | 5 | 2 |
| Anti-caking agent | | | | | | | | | | | | |

Table 2-continued

| | | | | | | | | | | | | |
|---|---|---|---|---|---|---|---|---|---|---|---|---|
| (Sample No. 7 used in Example 1) | 0 | 0.1 | 0.2 | 0 | 0.4 | 1 | 0 | 5 | 10 | 20 | 50 | 53 |
| Glauber salt | ← | | | | | | balance | | | | | → |
| Remarks* | R | R | F | R | R | F | R | F | F | R | R | R |
| Passage ratio (%) | 40 | 44 | 57 | 0 | 36 | 61 | 0 | 51 | 54 | 60 | 60 | 32 |

R: comparison F: present invention

As shown in Table 2, a sufficient anti-caking effect can be obtained when the anti-caking agent of the present invention is incorporated in an amount of at least 1/10 of the caking surface active agent. In other words, since in order to obtain a significant detergent effect the surface active agent having a tendency to cake must be incorporated in an amount of at least 2% based on the total composition, the anti-caking agent must be incorporated in an amount of at least 0.2%. If the amount of the surface active agent having a tendency to cake exceeds 40%, it is practically impossible to prevent caking. Accordingly, the amount of the anti-caking agent need not be larger than 3/2 of the amount of the surface active agent having a tendency to cake.

EXAMPLE 3

A powdery detergent having the following composition was prepared, and the passage ratio was evaluated to determine the caking tendency. The results are shown in Table 3.

Table 3.

| | |
|---|---|
| Surface active agent (shown in Table 3) | a parts |
| Sodium tripolyphosphate | 20 parts |
| Sodium silicate (JIS No. 2) | 10 parts |
| Sodium carbonate | 5 parts |
| Carboxymethylcellulose | 0.8 part |
| Polyethylene glycol (average molecular weight = 6000) | 0.2 part |
| Water | 8 parts |
| Anti-caking agent (See Table 3) | b parts |
| Glauber salt | balance |
| Total | 100 parts |

| Sample No. | Surface Active Agent | Amount(a) | Anti-Caking Agent Kind | Amount(b) | Remarks | Passage Ratio (%) |
|---|---|---|---|---|---|---|
| 49 | Sodium alkylethoxysulfate*1 | 15 | No. 7 of Example 1 | 0 | R | 0 |
| 50 | Sodium alkylethoxysulfate*1 | 15 | No. 7 of Example 1 | 3 | F | 75 |
| 51 | Sodium alkylethoxysulfate*2 | 20 | No. 7 of Example 1 | 0 | R | 0 |
| 52 | Sodium alkylethoxysulfate*2 | 20 | No. 7 of Example 1 | 5 | F | 70 |
| 53 | Sodium branched alkyl sulfate*3 | 30 | No. 15 of Example 1 | 0 | R | 42 |
| 54 | Sodium branched alkyl sulfate*3 | 30 | No. 15 of Example 1 | 5 | F | 80 |
| 55 | Sodium alkanesulfonate*4 | 35 | No. 15 of Example 1 | 0 | R | 8 |
| 56 | Sodium alkanesulfonate*4 | 35 | No. 15 of Example 1 | 8 | F | 85 |
| 57 | Sodium vinylidene type*5 olefin sulfonate | 18 | No. 7 of Example 1 | 0 | R | 43 |
| 58 | Sodium vinylidene type*5 olefin sulfonate | 18 | No. 7 of Example 1 | 7 | F | 87 |
| 59 | Sodium internal olefin*6 sulfonate | 17 | No. 7 of Example 1 | 0 | R | 28 |
| 60 | Sodium internal olefin-*6 sulfonate | 17 | No. 7 of Example 1 | 6 | F | 81 |
| 61 | Polyoxyethylene dodecyl ether*7 | 10 | No. 15 of Example 1 | 0 | R | 12 |
| 62 | Polyoxyethylene dodecyl ether*7 | 10 | No. 15 of Example 1 | 15 | F | 70 |
| 63 | Sodium dodecylbenzenesulfonate | 20 | No. 7 of Example 1 | 0 | R | 96 |
| 64 | Sodium dodecylbenzenesulfonate | 20 | No. 7 of Example 1 | 3 | R | 97 |
| 65 | Sodium linear alkyl sulfate*8 | 20 | No. 7 of Example 1 | 0 | R | 98 |
| 66 | Sodium linear alkyl surfate*8 | 20 | No. 7 of Example 1 | 4 | R | 100 |
| 67 | Sodium α-olefin-sulfonate*9 | 20 | No. 7 of Example 1 | 0 | R | 99 |
| 68 | Sodium α-olefin-sulfonate*9 | 20 | No. 17 of | 3 | R | 100 |

Table 3.-continued

| Example 1 |
|---|

Notes:
Surface active agents indicated in Table 3 are as follows:
*[1]Sodium salt prepared by adding 3.4 moles of ethylene oxide to a linear higher alcohol (having an average carbon atom number of 14) and sulfating and neutralizing the adduct.
*[2]Unitol C-S [manufactured by Nippon Unitol; sodium salt of secondary higher alcohol (carbon atom number of 14 to 15) ethoxysulfate].
*[3]Sodium salt of a sulfated product of oxoalcohol having an average molecular weight of 205.
*[4]Hostapur 60 (manufactured by Hoechst; average molecular weight = 319).
*[5]The average carbon atom number is 16.
*[6]Sodium salt of olefin-sulfonate (the olefin is composed mainly of internal olefin; α-olefin/internal olefin = 20/80; average carbon atom number = 16.2).
*[7]The mole number of added ethylene oxide units is 8.4.
*[8]Sodium salt of a sulfuric acid ester of a linear higher alcohol (having an average carbon atom number of 14).
*[9]Dialene 168 (manufactured by Mitsubishi Kasei; sodium α-olefin-sulfonate derived from linear α-olefin in which the $C_{16}$ content is 57.3% and the $C_{18}$ content is 42.7%).

From the results shown in Table 3, it will readily be understood that although powdery detergents containing a surface active agent have a high tendency to cake, the caking tendency of the detergents (F) of the present invention comprising the sodium salt (No. 7 of Example 1) of the carboxylic acid obtained by reacting PEG with succinic anhydride (mole ratio of 1/2) or the carboxylic acid obtained by reacting the Pluronic type nonionic surface active agent with maleic anhydride (mole ratio of 1/2) is highly reduced.

The embodiments of the invention in which an exclusive property or privilege is claimed are defined as follows:

1. A granular or powdery detergent composition consisting essentially of

I. from 2 to 40 percent by weight of a first surfactant having a tendency to cake selected from the group consisting of a. alkylethoxy sulfates having the formula

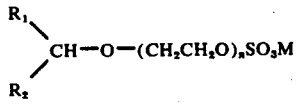

wherein $R_1$ and $R_2$, which can be the same or different, are hydrogens, alkyls having one to 17 carbon atoms, or alkenyls having two to 17 carbon atoms, provided that the average carbon atom number of

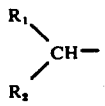

is from 10 to 18 carbon atoms, $n$ is a number of from 0.5 to 5, and M is an alkali metal or an alkaline earth metal, b. alkylphenylethoxy sulfates having the formula

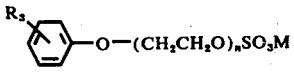

wherein $R_3$ is alkyl having 4 to 16 carbon atoms or alkenyl having 4 to 16 carbon atoms, provided that the average carbon atom number of

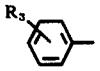

is from 10 to 18, and n and M are the same as defined above, c. branched alkyl sulfates having the formula

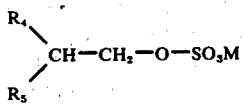

wherein $R_4$ and $R_5$, which can be the same or different, are alkyls having one to 15 carbon atoms or alkenyls having two to 15 carbon atoms, provided that

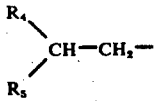

contains from 10 to 18 carbon atoms, and M is the same as defined above, d. alkane sulfonates having the formula

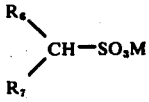

wherein $R_6$ and $R_7$, which can be the same or different, are hydrogens or alkyls having one to 17 carbon atoms, provided that

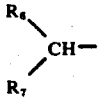

contains from 10 to 18 carbon atoms, and M is the same as defined above, e. sulfonate salts of vinylidene olefins having the formula

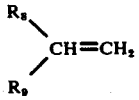

wherein $R_8$ and $R_9$, which can be the same or different, are alkyls having one to 15 carbon atoms, provided that the number of carbon atoms in the olefin molecule is from 10 to 18, and the salt-forming cation is an alkali metal or alkaline earth metal, f. sulfonate salts of internal olefins having the formula $R_{10}HC{=}CHR_{11}$ wherein $R_{10}$ and $R_{11}$, which can be the same or different, are hydrogens or alkyls having one to 17 carbon atoms, provided that the number of carbon atoms in the olefin molecule is from 10 to 20 and further provided that in up to 80 wt.% of the olefin molecules, one of $R_{10}$ and $R_{11}$ can be hydrogen, and in the balance of the olefin molecules, neither of $R_{10}$ and $R_{11}$ is hydrogen, and the salt-forming cation is an alkali metal or alkaline earth metal, g. ethylene oxide nonionic surface active agents having an HLB value of from 8 to 18 and selected from the group consisting of polyoxyethylene (6 to 12) alkyl ($C_{12}$ to $C_{18}$) or alkenyl ($C_{12}$ to $C_{18}$) ethers, polyoxyethylene (6 to 12) alkyl ($C_6$ to $C_{10}$) phenyl ethers, polyoxyethylene (8 to 20) saturated or unsaturated fatty acid ($C_{12}$ to $C_{18}$) esters and polyoxyethylene (4 to 20) sorbitan saturated or unsaturated fatty acid ($C_{12}$ to $C_{18}$) esters, and mixtures thereof, II. from 0.2 to 20 weight percent of an anti-caking agent, being a carboxylic acid or an alkali metal salt thereof, obtained by reacting at 50 to 100° C without any catalyst A. a polyalkylene glycol selected from the group consisting of (i) polyethylene glycol having an average molecular weight of from 2000 to 10000 and (ii) a nonionic surfactant having the formula $$HO(CH_2CH_2O)_a(\underset{\underset{CH_3}{|}}{C}HCH_2O)_b(CH_2CH_2O)_cH$$

wherein $140 \leqq a+c \leqq 200$ and $30 \leqq b \leqq 40$, with

B. an acid anhydride selected from the group consisting of maleic anhydride, phthalic anhydride and succinic anhydride, at a molar ratio of A/B of from 1/2 to 1/1, wherein the weight ratio of II/I is from 1/10 to 3/2, III. from zero to 20 percent by weight of second surfactant selected from the group consisting of alkylbenzene sulfonates in which the alkyl has 10 to 16 carbon atoms, linear alkyl sulfates having an average of 11 to 18 carbon atoms, α-olefin sulfonates having 10 to 20 carbon atoms and mixtures thereof, and IV. from 10 to 40 weight percent water-soluble inorganic alkaline detergent builders, or water-soluble inorganic neutral detergent builders, or water-soluble organic detergent builders, or mixtures thereof.

2. A composition as claimed in claim 1 in which the amount of component I is from 6 to 25 weight percent, the amount of component II is from 1 to 10 weight percent, and n of component II is from 200 to 300.

3. A composition as claimed in claim 2 in which the amount of component II is from 3 to 8 weight percent.

4. A composition as claimed in claim 1 in which said polyalkylene glycol (A) is polyethylene glycol having an average molecular weight of from 4000 to 8000.

5. A composition as claimed in claim 1 in which said polyalkylene glycol is said nonionic surfactant.

* * * * *